US009080813B1

(12) United States Patent
Deckebach

(10) Patent No.: US 9,080,813 B1
(45) Date of Patent: Jul. 14, 2015

(54) ADJUSTING ROTATIONAL SPEEDS OF ROTARY KILNS TO INCREASE SOLID/GAS INTERACTION

(76) Inventor: George J. Deckebach, Cincinnati, OH (US)

( * ) Notice: Subject to any disclaimer, the term of this patent is extended or adjusted under 35 U.S.C. 154(b) by 649 days.

(21) Appl. No.: 12/798,873

(22) Filed: Apr. 12, 2010

(51) Int. Cl.
*F27B 7/20* (2006.01)
*F27B 7/00* (2006.01)

(52) U.S. Cl.
CPC .... *F27B 7/20* (2013.01); *F27B 7/00* (2013.01)

(58) Field of Classification Search
CPC ..... F27B 7/00; F27B 7/20; F27B 7/28; F27B 7/14; F26B 11/04; F26B 11/028
USPC ..... 432/110, 103, 118, 105, 108; 34/58–59, 34/312–314; 266/173
See application file for complete search history.

(56) References Cited

U.S. PATENT DOCUMENTS

| | | | | |
|---|---|---|---|---|
| 1,735,393 | A | 11/1929 | Hiller | |
| 1,889,989 | A | 12/1932 | Hughes | |
| 2,238,161 | A | 4/1941 | Drew et al. | |
| 2,501,763 | A | 3/1950 | Denker et al. | |
| 3,426,839 | A | 2/1969 | Overton | |
| 3,464,683 | A | 9/1969 | Enk | |
| 3,588,950 | A * | 6/1971 | Marshall | 425/7 |
| 3,773,397 | A | 11/1973 | Struttmann | |
| 3,998,440 | A | 12/1976 | Atkinson | |
| 4,014,106 | A | 3/1977 | Bearce | |
| 4,038,025 | A * | 7/1977 | Kratochvil | 432/13 |
| 4,136,965 | A * | 1/1979 | Sunnergren et al. | 366/25 |
| 4,137,675 | A | 2/1979 | Cina et al. | |
| 4,140,629 | A | 2/1979 | Martindale | |
| 4,191,530 | A | 3/1980 | Bearce | |
| 4,205,919 | A | 6/1980 | Attwell | |
| 4,288,215 | A * | 9/1981 | Grim | 432/103 |
| 4,339,999 | A | 7/1982 | Fio Rito et al. | |
| 4,416,570 | A | 11/1983 | Argenbright | |
| 4,576,572 | A * | 3/1986 | Mueller et al. | 432/13 |
| 4,583,468 | A | 4/1986 | Reed et al. | |
| 4,724,777 | A * | 2/1988 | Reed et al. | 110/246 |
| 4,730,564 | A | 3/1988 | Abboud | |
| 5,068,979 | A * | 12/1991 | Wireman et al. | 34/58 |
| 5,295,821 | A | 3/1994 | Daukss | |
| 5,692,313 | A * | 12/1997 | Ikeda et al. | 34/58 |

(Continued)

OTHER PUBLICATIONS

Mellmann J. The transverse motion of solids in rotating cylinders—forms of motion and transition behavior. Powder Technology [serial online]. Jan. 1, 2001;118:251-270.*

(Continued)

*Primary Examiner* — Steven B McAllister
*Assistant Examiner* — Ko-Wei Lin
(74) *Attorney, Agent, or Firm* — Hasse & Nesbitt LLC; Donald E. Hasse

(57) ABSTRACT

Greatly enhanced interaction of material processed by a rotary kiln with gas introduced into the rotary kiln is provided by initially rotating the rotary kiln at a rotational speed causing the material to be transported by centrifugal force to an upper portion of the shell of the kiln, and thereafter maintaining a rotational shell speed that causes centrifugal forces acting upon the material to be greater than seventy percent of gravitational forces acting upon the materials but less than one-hundred percent of gravitational forces acting upon the material. When this percent is between ninety and ninety-five percent of such gravitational forces tests indicated that the enhancement was maximized.

17 Claims, 5 Drawing Sheets

(56) References Cited

U.S. PATENT DOCUMENTS

| | | | | |
|---|---|---|---|---|
| 5,927,969 | A * | 7/1999 | Dover et al. | 432/103 |
| 5,997,289 | A | 12/1999 | Dover | |
| 6,027,338 | A | 2/2000 | Okinaka et al. | |
| 6,042,370 | A | 3/2000 | Weide | |
| 6,186,778 | B1 | 2/2001 | Bonin | |
| 6,257,878 | B1 | 7/2001 | Marr et al. | |
| 6,688,884 | B2 | 2/2004 | Thibault et al. | |
| 6,860,735 | B1 * | 3/2005 | Shimono | 432/118 |
| 6,901,868 | B2 | 6/2005 | Hornung | |
| 7,204,636 | B2 * | 4/2007 | Didion | 366/147 |
| 2003/0140427 | A1 * | 7/2003 | Yamamoto et al. | 8/159 |
| 2003/0233765 | A1 * | 12/2003 | Heinzen et al. | 34/321 |
| 2008/0209759 | A1 * | 9/2008 | Shivvers | 34/514 |
| 2009/0127754 | A1 | 5/2009 | Shima et al. | |

OTHER PUBLICATIONS

U.S. Appl. No. 12/798,812, filed Apr. 12, 2010, George J. Deckebach.
USPTO Office Action dated Feb. 11, 2014 issued in U.S. Appl. No. 12/798,812 (14 pages).
USPTO Final Office Action dated Jul. 29, 2014 issued in U.S. Appl. No. 12/798,812 (21 pages).
Stanev et al., Geometrical Characteristics of the Solid Bed in a Rotary Kiln, Journal of Chemical Technology and Metallurgy, 49, 1, 2014, pp. 82-89 (8 pages).

* cited by examiner

ADJUSTING ROTATIONAL SPEEDS OF ROTARY KILNS TO INCREASE SOLID/GAS INTERACTION

BACKGROUND OF THE INVENTION

The Invention Relates to the Field of Rotary Kilns

Many processes performed by rotary kilns require heat to raise the temperature of a material or assist in a particular chemical reaction, where the atmosphere inside the kiln is not involved in the reaction. However some reactions do require interaction with the atmosphere. Oxidation/reduction reactions are included in this category. In the specification, we will disclose a particular example of removing combustible contaminants from foundry sand for the purpose of beneficial reuse.

However, the method disclosed in the following specification may be applicable in other applications. Instead of foundry sand, the granular burden material may be a fuel such as sawdust, coal, or coke breeze. The kiln becomes a furnace. The kiln can also become, under reducing conditions, an ore processor. Non-redox reactions like nitriding power metal would benefit from the incorporated designs.

In a simple rotary kiln, i.e. one that has no flighting, only the surface of the sand is exposed to the kiln's atmosphere. Sand grains below the surface are "smothered" by the grains lying between their position and the surface, as oxygen trying to reach the subsurface sand would require transmission through a torturous path. Products of combustion would experience the same difficulty when traveling in the opposite direction. This condition makes the combustion process very inefficient. Long retention times would be required.

To improve this process, kiln manufacturers have incorporated flighting mechanisms or flights within the kiln for containing and lifting a portion of the burden and drop it progressively as the kiln rotates, creating a "waterfall" or "cascading" effect. This "waterfall" effect allows the burden to fall through the atmosphere, providing enhanced contact or interaction between the burden and the atmosphere. Although this is an improvement over the simple kiln, it is not a substantial improvement. If a snapshot would be taken at any point in time, it would reveal that only a small portion of the sand is in freefall. The majority of sand is still in a smothered condition, either lying on the kiln wall, or lying on the flights themselves. Minor improvements can be made by the proper choice of type of flights used, along with the number of them positioned around the circumference, and their depth in relation to the depth of the burden. However, the benefit of these improvements still leaves much to be desired.

BRIEF SUMMARY OF PREFERRED EMBODIMENTS OF THE INVENTION

The present invention maximizes the use of rotational speed to substantially increase solid/gas interaction. The preferred speed of kiln shell rotation is just below the speed where centrifugal force is equal to the force of gravity. If this speed is reached or surpassed, the granular material could stay attached to the sidewall for the entire 360 degrees of rotation and greatly reduce the desired solid burden/gas interaction otherwise attainable by the invention.

If however, in accordance with my invention, preferred speeds are chosen where centrifugal force is slightly less than gravity; and the granular material e.g. sand will appear to adhere to the side wall of the kiln until it almost reaches the apex of the kiln. As indicated in FIG. 5, at this point, the sand separates from the wall, first moving away from the wall by a combination of tangential and gravitational forces, then finally, solely by gravity, downwardly. This action, at any point in time, beneficially provides for almost as much material in freefall as there is material on the sidewall, enhancing exposure of the granular material to the kiln's atmosphere. Additionally, each revolution of the kiln may cause the freefall of up to 100% of the burden, thereby further maximizing the amount of burden in freefall per revolution for interaction with the gas.

Besides robust beneficial freefall, the material on the sidewall can also cover nearly one half of the kiln's diameter as shown in FIG. 5 and provide greater burden surface area for interaction with the gas, further enhancing exposure to the kiln's atmosphere.

Additionally, once centrifugal force is used to carry burden to the apex, or nearly to the apex of the kiln, conventional flights are no longer needed, saving manufacturing costs.

DETAILED DESCRIPTION OF A KILN WHICH MAY BE USED IN CARRYING OUT THE METHOD OF THE INVENTION

A primary objective of the design of the kiln is to lower the cost of manufacturing a rotary kiln in two ways. The first way increases the strength to weight ratio through structural design. Instead of producing a simple heavy wall kiln that must be strong enough to support both itself and its burden (the weight of the material being treated) without undue deflection, the invention provides a thin walled kiln having enhanced strength owing to a skeleton of ribs. This structure is similar to the "rib and skin" arrangement used in the production of aircraft fuselage and wings. This type of construction can be particularly beneficial when, due to process requirements, the materials of construction are expensive. Secondly, my design of the support structure of the kiln converts the undesirable prior art four point support to a two point support. Just as a four legged chair always suffers from non-planar legs or a non-planar floor, the typical four point support used for most kilns require expensive solutions to mitigate this problem. A two point support system eliminates much of this expense.

Besides lowering construction cost, my design offers other advantages: A simple way of adjusting the rate of process material flow after installation; and in cases where heat transfer between the kiln walls is required in processing, faster start-up times and higher rates of heat transfer can be produced.

Figures 1, 2:
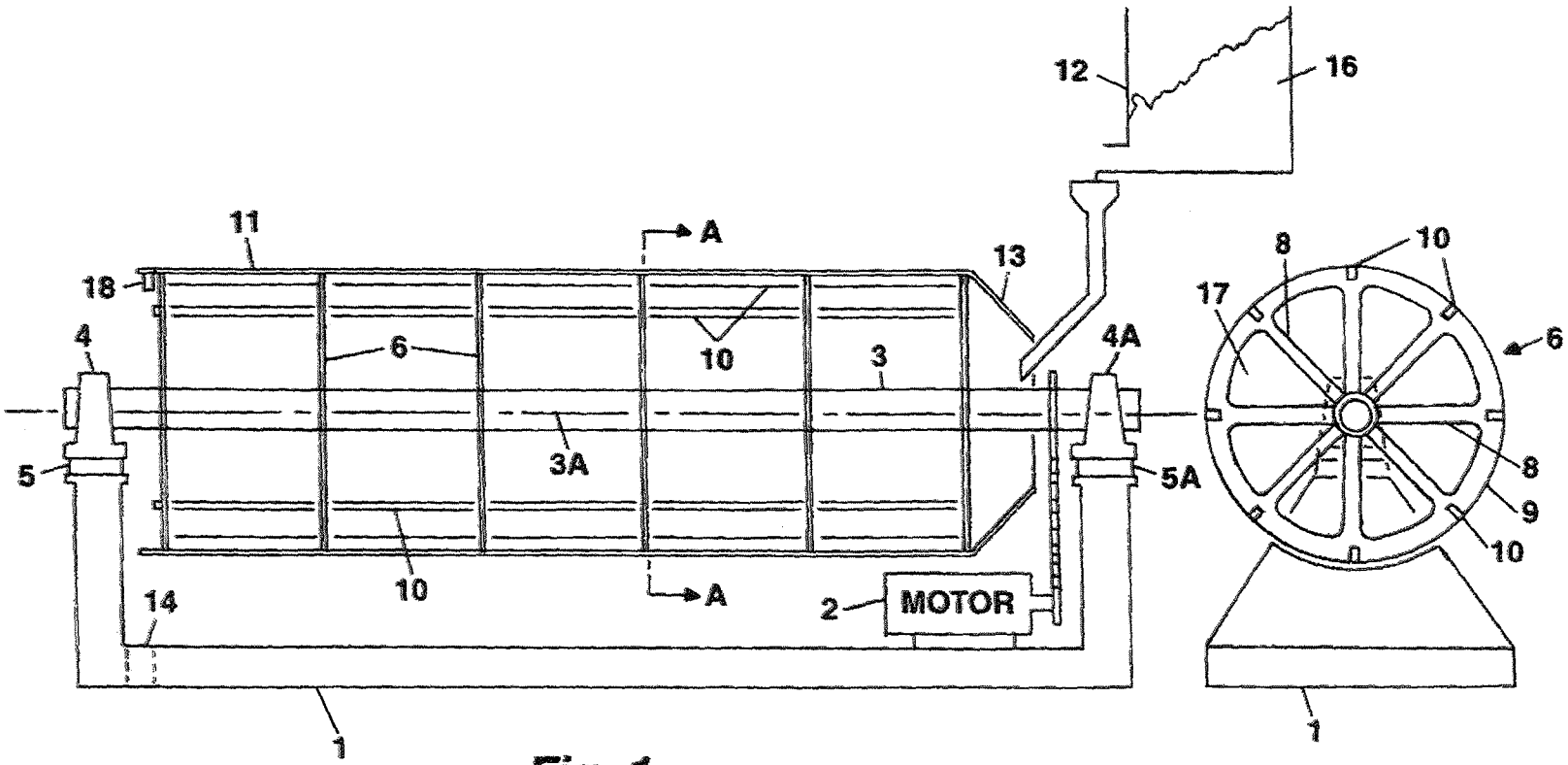
FIG. 1 represents a sectional view of the kiln used and tested in accordance with the method of the present invention when the section is taken through the axis of rotation and perpendicular to the invention's base.
FIG. 2 represents a sectional view along line A-A of FIG. 1. This section is perpendicular to the axis of rotation.

The frame 1 in FIGS. 1 and 2 supports the rotary kiln body. A motor and drive unit 2 suitably rotates the main shaft 3, which is concentric to the axis of rotation 3*a*. The shaft is supported by two self aligning bearings 4 and 4*a*. The bearings with their housings are commercially available. The self-aligning type are greatly preferred. Spacer blocks 5 and 5*a* are located between the bearing housings and the frame 1. Connected to the main shaft are a series of thin support wheels 6. The support wheels are attached to the main shaft at intervals along the length of the shaft. The support wheels are perpendicular to the main shaft and their rib or rim circumferences 9 are also concentric with the axis of rotation 3*a*.

Figure 3:
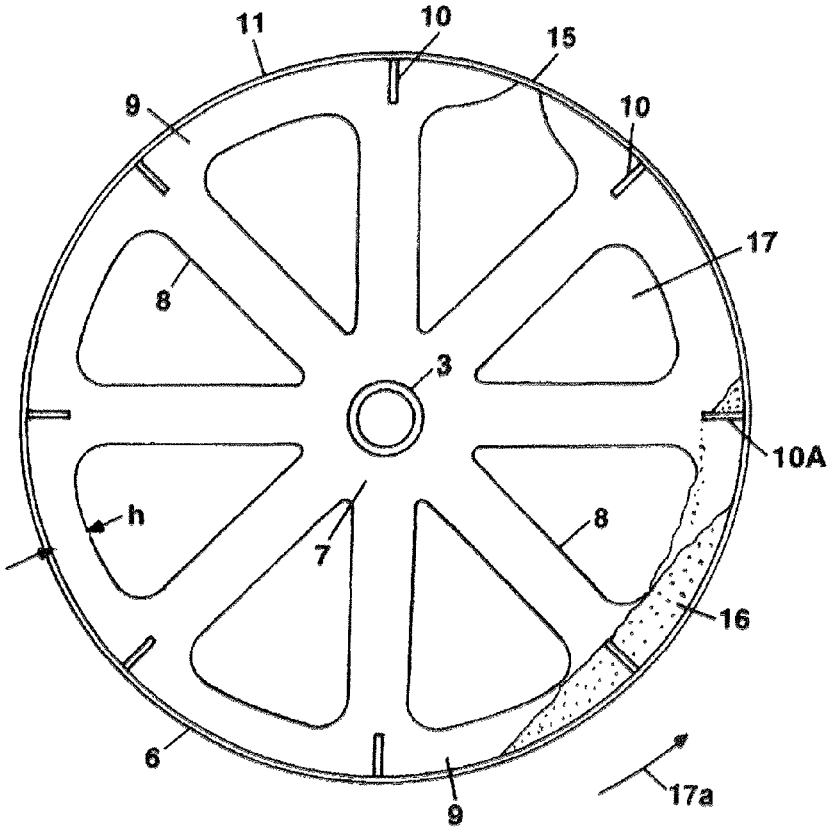
FIG. 3 is similar to FIG. 2, except that certain additional elements have been added.

As depicted in FIGS. 2 and 3, each support wheel is comprised of: a hub section 7 spokes 8, and a circular beam or wheel rim 9. They thus resemble old time wagon wheels. The spokes thus contain radially extending apertures 17. These apertures resemble pie-shaped cutouts. Attached to the rims of the support wheels are longitudinal beams or ribs 10 shown in all three figures. The lengths of these beams are parallel to the axis of rotation 3*a* and the beams are evenly spaced around the circumference of the support wheels. Finally, the kiln's shell 11 is formed around the circular rim 9 of each wheel and all of the longitudinal beams 10 along their lengths as shown in FIGS. 1 and 3.

As shown in FIG. 1, a feed mechanism 12 will feed material or burden 16 into the kiln. A conical end 13 is positioned adjacent the shell at the inlet end. This will keep burden from accidentally discharging at the inlet. The material will then flow to the opposite end of the kiln to discharge area 14, as is well known in the art.

As shown in FIG. 3, the longitudinal ribs or beams 10 are located at the end of each spoke, but may be located at other locations around the circumference as well. These beams may optionally be modified by size or shape to act as anti-slide mechanisms and/or as lifting flights.

As shown in FIG. 3, the circular beam or wheel rim 9 has a height of "h". Changing "h" will not only affect the strength of the circular beam, it may also affect the amount of retention of process material in the kiln during operation. Each support wheel may act as a weir or dam, thereby affecting the retention time of burden in the kiln. The support wheels can be designed so that "h" goes to zero at the midpoint of some or all of each rib section between the spokes if desired, e.g. at 15 in FIG. 3, or alternatively increased to retain more burden. Note that the processed material or burden 16 is depicted in FIG. 3, where the kiln has a counterclockwise rotation indicated by arrow 17*a*. The depth of burden is controlled by "h". Once the depth of burden is greater than "h", burden will spill into the next adjacent chamber, or if the adjacent chamber is the last chamber, out of the kiln. It should be noted that the control of burden retention via changing weir height h will be most pronounced at low rotational speeds and with a minimum of lifting flights. Higher and/or more frequent dropping of burden will reduce the effect of the weirs, as falling material may rebound over the top of the weirs.

This kiln design has several unique features. Consider the structure's very high strength to weight ratio. The light weight "skeleton" of the kiln is comprised of the main shaft 3, the thin support wheels 6, and the longitudinal beams or ribs 10. At any point in time during rotation, the longitudinal ribs that happen to be positioned at the top will be in compression, and the ribs that happen to be at the bottom will be in tension, due to the weight of burden and the kiln itself. This aspect of the invention means that the longitudinal ribs being connected to and between the support wheels, act in concert to form a large rotating beam and accordingly, the transverse strength of the kiln along the axis of rotation 3*a* will be remarkably strong.

The outer shape of this ribbed structure will keep the kiln's shell or skin 11, formed about the longitudinal ribs and wheels from deforming, even if the shell is unusually thin, in order to beneficially reduce kiln weight. The shell's cylindrical shape will then also contribute to the transverse strength of the total unit. The high strength to weight ratio provided by the invention can be of substantial economic benefit when construction materials become expensive. This type of construction would gain favor when certain processes would require costly materials. Materials such as stainless steel, other types of high alloy steels, titanium, or noble metals would be good examples.

It should be noted that the shell 11 may be securely attached to the frame by fasteners or welding, or it may be only secured by end stops, which would beneficially allow some horizontal movement due to temperature changes. Using end stops would allow the shell 11 to expand at a different rate than the ribbed frame without causing undue stress, should the kiln be used for a thermodynamic process. In this case, the conical end 13 at the inlet will acts as one end stop. The second end stop 18 at the discharge area, could be attached to the terminal portion of the shell as shown in FIG. 1, or to the outside of the last support wheel. It can assume the form of an annular ring that is concentric with the longitudinal axis 3*a* of the driveshaft.

In the special case where the process requires a process temperature other than ambient, several additional advantages come into play. With regard to start-up time, this design will take less time to go from ambient to equilibrium process temperatures. This beneficial effect is attained when the mass or weight of the kiln is lowered in accordance with the "skeleton" configuration of the kiln of the invention. The lower the mass, the lower the heat capacity or heat sink the kiln would have. Furthermore, if a process requires heat to be transferred into or out of the kiln, the thin shell wall would facilitate the desired increased rate of heat transfer. The thickness of the kiln's wall is inversely proportional to the rate of heat transfer through the wall.

The use of support blocks 5 and 5*a* beneath the bearings 4 and 4*a* provides for a quick and simple means of adjusting the throughput rates and retention time of the material being processes by the kiln by adjusting the height of the support blocks 5 shown in FIG. 1. Kiln designers have used techniques such as weir height h in FIG. 3, or rifled flighting to control burden flow rates through the kiln. However, these techniques are incorporated into the design during construction and cannot be easily modified in the field. The provision of the spacer blocks 5 and 5*a* between the frame and the bearings 4 and 4*a* allows for field adjustment by simply replacing a block with another taller or shorter block. This will change the inclination of the kiln without disturbing the kiln's base. Material being fed into a kiln at a slight downward decline will move faster than in a level kiln.

Also, my design beneficially only requires a two point support for rotation, i.e. the two bearings supporting the main shaft. Kilns generally use a four point support: the two main tires that are outside the kiln's wall and concentric to its rotational axis are each generally supported by two support wheels or rollers positioned under the tires. See for example, FIG. 1 of U.S. Pat. No. 4,730,564 issued Mar. 15, 1988 to Abboud. It should be understood that this support is not really a point, but a line. This line is the contact between the tires and the wheels; the length of the line is defined by the width of the tire. This four line arrangement requires precision alignment. The four contact lines between tires and wheels should be absolutely planar. If not, uneven loading will occur. Secondly, all four contact lines should be perfectly parallel to each other and at the same time parallel to the kiln's axis of rotation. If not, undue wear of tire and wheel surfaces will occur, and the kiln will want to migrate either forward or backward. This in turn will create large thrust forces. The kiln will try to "walk" off the wheels. To solve these problems, precision machining and assembly of all drive components is required. Accurate foundation work and field assembly will also become critical. The present invention can beneficially employ use of a two point support system, in combination with the use of commercially available, self-aligning bearings.

Figure 4:
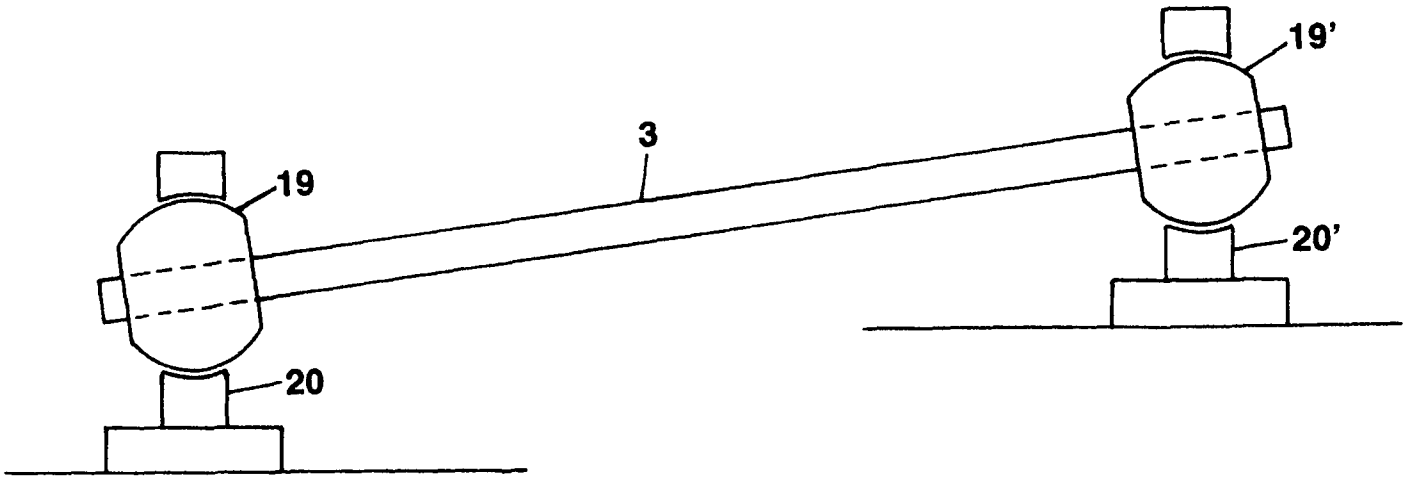
FIG. 4 is a schematic representation of a self-aligning bearing system couple to the kiln driveshaft and employed in the kiln which may be used in accordance with the method of the present invention.

The self aligning bearings allow for the rotational bearings to be housed within a special spherical housing, where the center of the sphere lies on the axis of rotation. FIG. 4 depicts the basic configuration of these commercially available bearings. The kiln drive shaft 3 is supported by two bearings 19 and 19', whose housings 20 and 20' are purposely shown as misaligned. The housings have a spherical inner surface, which mates with the spherical outer surface of the bearings.

With this special arrangement, the two bearing housings can be misaligned either horizontally and/or vertically, and will not cause any alignment problems between the bearings themselves. The previously mentioned spacer blocks 5 works quite well because of this feature. Therefore, this "two point" system is really a two line system. The use of self aligning bearings, along with their spherical housings will beneficially keep the axis of rotation of both bearings both parallel and concentric to the kiln's shaft, hence becoming one line.

This feature substantially reduces the cost of my kiln's construction. The bearing housings can be mounted on unmachined weldments or other low tolerance structures, as small horizontal or vertical misalignments will be of no consequence. Much if not all machining operations may be eliminated.

Figure 6:
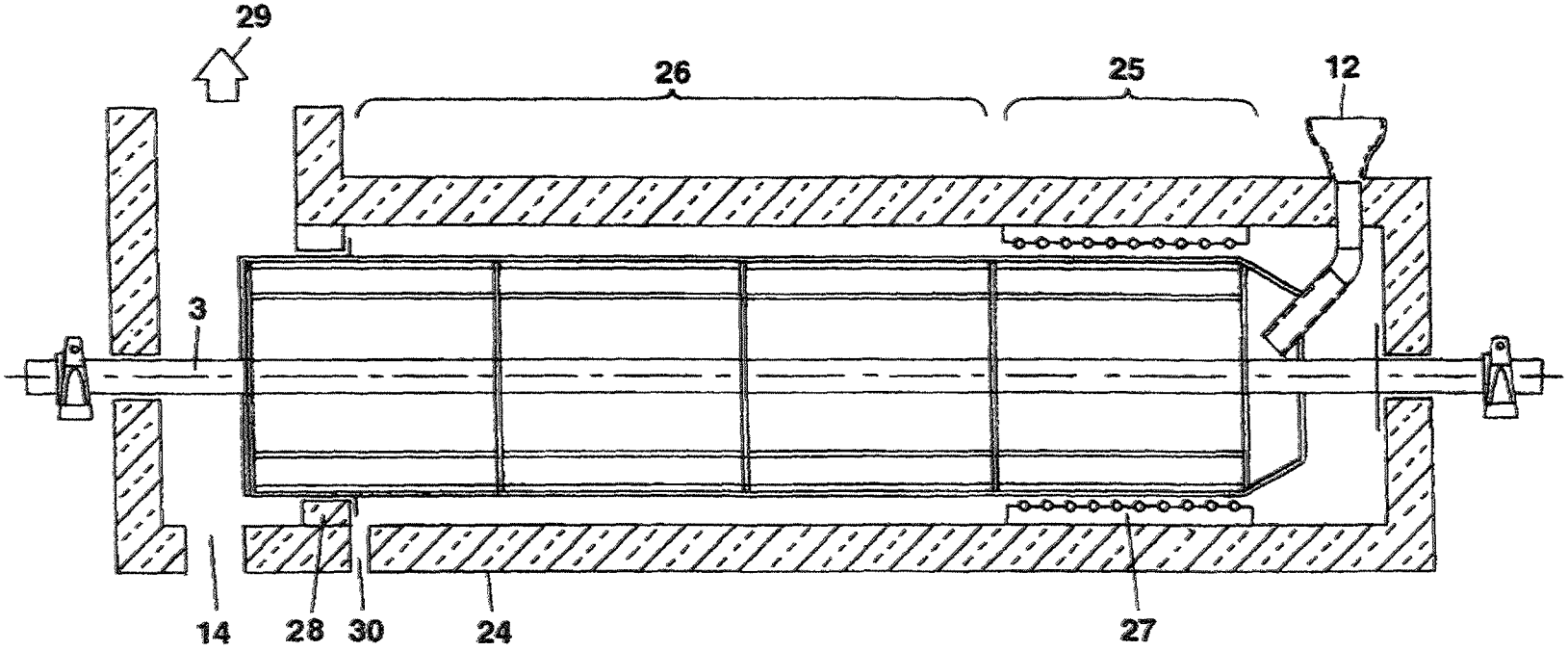
FIG. 6 shows energy saving heat transfer apparatus for conveying heat from the granular material being processed to combustion air, if used, for efficiently preheating the combustion air and cooling the granular material.

FIG. 6 illustrates the preferred embodiment for sand reclamation. The kiln is housed within an insulated chamber 24. The chamber may have any suitable cross-section. The chamber is comprised of two zones: the heated zone 25, and the combustion air preheat zone 26. Electric heating elements 27 indirectly heat the kiln. Other suitable means of heating can also be used, indirectly from between the insulated chamber and the outside of the kiln, or directly inside the kiln as well. The preheat zone and heated zone is separated from the kiln discharge by the separation baffle 28. At material discharge at area 14, a means is provided for combustion gases 29 to exit the system. The combustion air inlet 30 is provided in the combustion air preheat zone near the separation baffle. Material inlet is introduced at area 12.

This configuration allows for a simple means of preheating combustion air. As the space between the kiln and the insulated chamber is essentially sealed with the exception of the combustion air inlet, combustion air must flow between the kiln and insulated chamber countercurrent to the flow of sand. The combustion air can then enter the inside of the kiln through the conical inlet end. The exiting sand, via heat transfer through the kiln wall can then preheat the incoming combustion air. At the same time the corresponding reduction of the sand temperature is beneficial. This will reduce the processing cost associated in further lowering the sand's temperature to ambient or usable condition.

The aforesaid kiln used to field test the method of the present invention constructed in accordance with the present invention had the following parameters: overall kiln dimensions: wall =20 inches in diameter by 80 inches long; main shaft =2.0 inches in diameter, schedule 80 pipe; wheels and kiln wall are 14 gage (0.0747 inches) in thickness; ribs are 0.75 inches by 0.0747 inches by 80 inches in length.

THE METHODS OF THE PRESENT INVENTION

My invention maximizes the use of rotational speed to substantially increase solid/gas interaction. The preferred speed of rotation of the above described kiln shell is just below the speed where centrifugal force is equal to the force of gravity. If this speed is reached or surpassed, the granular burden could stay attached to the sidewall for the entire 360 degrees of rotation and render the kiln without beneficial high degree of gas/material interaction.

Figure 5:
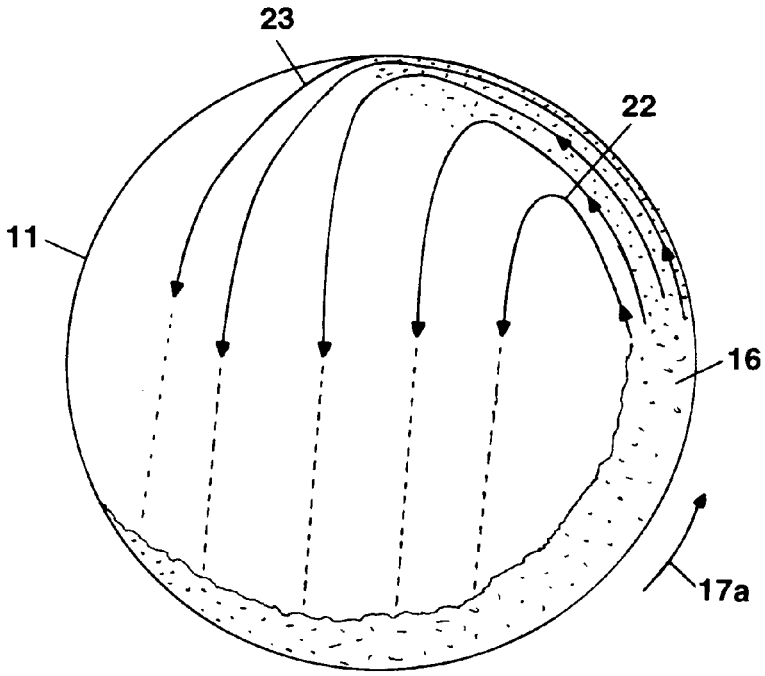
FIG. 5 represents a cross sectional view perpendicular to the axis of rotation for sand reclamation, which depicts the mechanical aeration of the burden in accordance with the method of the present invention.

If however, in accordance with the present invention, a preferred rotational speed (RPM) of the kiln shell is chosen where centrifugal forces acting on the granules are slightly less than gravity, the sand will appear to adhere to the side wall of the kiln until it almost reaches the apex of the kiln. As indicated in FIG. 5, at this point, the sand separates from the wall, first moving away from the wall by a combination of tangential and gravitational forces, then finally, solely by gravity, downwardly. This action, at any point in time, beneficially provides for almost as much material in freefall as there is material on the sidewall for high degree of interaction with the gas. Additionally, each revolution of the kiln can cause the freefall of 100% of the burden, thereby maximizing the amount of burden in freefall per revolution. Once centrifugal force is used to carry burden to or nearby the apex of the kiln, conventional flights are no longer needed, saving manufacturing costs. Although such flights are not required for lifting, anti-slide members may be required to keep material from sliding downwardly on kiln's shell inner surface portions, if the coefficient of friction between the kiln shell and the burden would be too low. These members need not be large. Other means, such as a roughened inner surface of the kiln may be used as an alternate to flights. The longitudinal ribs or beams 10 depicted in FIGS. 1-3 of the drawings can have the dual function or purpose of acting as anti-slide bars if needed, along with providing support for the kiln's shell as previously explained.

Besides robust beneficial freefall, the material on the sidewall can also cover nearly one half of the kiln's diameter as shown in FIG. 5 and provide greater granular surface area exposed to the gas, further enhancing exposure to the kiln's atmosphere.

Choosing a high speed of rotation provides for yet another improvement in solid burden/gas interaction. Although the burden is a solid material, it is not completely solid. Foundry sand is approximately 75% solid material with 25% of its volume being a gas that assumes the space between the individual grains of sand. Sand, even in a "smothered" condition would then allow for interaction between the solid and gas until the reactive portion of the gas is depleted. The higher the speed of rotation, the shorter the time the burden is in a "smothered" condition and less depletion occurs. This allows for greater and additional reaction to occur, even when "smothered".

Therefore, in accordance with the invention, increasing the rotational speed:

1) Provides more burden freefall per unit of time.
2) Provides less time for the burden to be in the "smothered" condition.

And further increasing the rotational speed to where centrifugal force is used for lifting:

3) Maximizes both 1) and 2).

4) Burden lying on the kill's shell is further spread out, increasing surface area of burden exposed to gas.

5) Flighting is reduced or eliminated.

In summary, in accordance with the present invention, choosing a speed of rotation that is just below the speed where centrifugal force is equal to the force of gravity, maximizes both the amount of burden that is exposed to the kiln's atmosphere in each revolution, and the number of revolutions per unit of time, creating a multiplicity of exposure between burden and atmosphere. This greatly enhanced interaction between the sand and the kiln's atmosphere reduces the size of the kiln required, and the retention time required within the kiln for processing burden at a given rate.

Field tests were done on the 20" diameter kiln of my prototype using sand as the burden material. At this diameter, centrifugal force equals gravity at approximately 59.34 RPM. As RPM's were increased from a very slow speed, initial separation of the sand from the sidewall provided by centrifugal force started at about 42 RPM, or approximately 70% of the force of gravity. The highest most beneficial degree of sand freefall was noted at about 53 to 56 RPM, or approximately 90-95% of the force of gravity.

The field tests also had shown that the separation of sand from the kiln wall did not occur at a singular point on the kiln's circumference, but over a range of the circumference. See FIG. 5.

As the burden 16 lying on the kiln shell wall 11 being rotated as indicated by arrow 17*a* has a finite depth, the burden's diameter also becomes a range. Therefore the sand at the surface 22, having the smaller inner burden diameter and thus subject to less centrifugal force, separates first from the wall, and the sand contacting the wall at 23 separates last, thereby creating the range of separation. Sand in free fall is indicated by the arrows Thus, the method of the invention may involve:

(a) rotating the rotary kiln at a rotational speed for causing the material to be transported by centrifugal force to upper portions of the shell; and (b) maintaining for a period a rotational speed of the shell that causes centrifugal forces acting upon the materials to spread out, as shown in FIG. 5, and occupy more of the inner surface portions of the shell, thereby increasing exposure of the material to gas passing through the shell and (c) wherein the rotational speed of the shell causes material to flow downwardly by virtue of gravity from the upper portions of the shell, thereby to further enhance the interaction of material passing through the kiln with the gas introduced into the rotary kiln.

In accordance with the invention, beneficial high degree of solid to gas interaction is produced when the rotational speed of the rotary kiln causes centrifugal forces acting upon the material to be at least seventy percent of gravitational forces acting upon the materials but less than one-hundred percent of gravitational forces acting upon the material.

Interaction between materials and gas may be even further enhanced wherein this percentage is between ninety percent of gravitational forces acting upon the materials but slightly less than one-hundred percent of gravitational forces. The currently most preferred percentage appears to be between ninety and ninety-five percent.

As would be apparent, to workers in the art, the actual rotational speeds in revolutions per minute will vary to obtain the benefits of the invention depending on the kiln shell diameter. This is because centrifugal forces will increase with greater shell diameters rotating at the same RPM. However, the worker in the art obtains the benefits of the invention by observing the substantial distribution of the flowable material about the inner arcuate shell surfaces and the robustness of the "waterfall" as shown in FIG. 5 and the related aforesaid text. This observation could be carried out by viewing the left portion of the kiln shown in FIG. 1. The lifting and freefall of material as depicted in FIG. 5 can be easily observed, as the area between the spokes 8 of the support wheels 6 is quite large.

In accordance with my invention, flights are not required for lifting, but anti-slide members may only be required to keep material from sliding downwardly on the kiln's shell inner surface, if the coefficient of friction between the kiln shell and the burden would be too low. These members need not be large. Other means, such as a roughened inner surface of the kiln may be used as an alternate to flights. As depicted in the drawings, the longitudinal ribs or beams 10 have the dual function or purpose of acting as anti-slide bars, along with providing support for the kiln's shell.

Besides robust beneficial freefall, the material on the sidewall can also cover nearly one half of the kiln's diameter as shown in FIG. 5 and provide greater material surface area, further enhancing exposure to the kiln's atmosphere.

While the invention has been described in connection with preferred embodiments, the description is not intended to limit the scope of the invention to the particular forms set forth, but on the contrary, it is intended to cover such alternatives, modifications, and equivalents as may be included within the spirit and scope of the invention as indicated by the language of the appended claims.

For example the term "material" as used herein includes any material that may be processed by a rotary kiln and which can be manipulated in accordance with the above descriptions relating to FIG. 5 to enhance interaction with a gas passing through the rotary kiln.

I claim:

1. A method of increasing interaction of solid material processed by and passing through a rotary kiln having a shell with gas inside the rotary kiln, wherein said material passes through the kiln from an inlet end to a discharge area at the opposite end of the kiln, said method including:

(a) rotating the rotary kiln thereby causing the material to be transported by centrifugal force upwardly on said shell without the use of flights; and (b) rotating the rotary kiln for a period at a rotational speed that causes said material to spread out thereby increasing exposure of said material to said gas without the use of flights and (c) wherein the maximum rotational speed of said shell is just below the speed where the centrifugal force acting upon said material is equal to the gravitational force, and said rotational speed of said shell causes centrifugal forces acting upon said material to be greater than seventy percent of gravitational forces acting upon said material but less than one-hundred percent of gravitational forces acting upon said material, and causes 100% of said material to flow downwardly in freefall solely by virtue of gravity from said shell per revolution of the kiln, thereby to further enhance said interaction of material passing through the kiln with said gas inside the rotary kiln.

2. The method of claim 1 wherein the rotational speed of said rotary kiln causes centrifugal forces acting upon said material to be greater than ninety percent of gravitational forces acting upon said material but less than one-hundred percent of gravitational forces acting upon said material.

3. The method of claim 1 wherein said material is granular material.

4. The method of claim 2 wherein said material is granular material.

5. The method of claim 3 wherein said granular material is sand.

6. A method of increasing interaction of solid material processed by and passing through a rotary kiln having a shell with gas inside the rotary kiln, wherein said material passes through the kiln from an inlet end to a discharge area at the opposite end of the kiln, said method including:

(a) rotating the rotary kiln thereby causing said material to be transported by centrifugal force upwardly on said shell without the use of flights; and (b) rotating the rotary kiln without the use of flights at a rotational speed for a period that causes centrifugal forces acting upon said material to be greater than seventy percent of gravitational forces acting upon said material but less than one-hundred percent of gravitational forces acting upon said material, wherein the maximum rotational speed is below the speed where the centrifugal force acting upon said material is equal to the gravitational force, and said rotational speed causes 100% of said material to flow downwardly in freefall solely by virtue of gravity from said shell per revolution of the kiln.

7. The method of claim 6 wherein the rotational speed of said rotary kiln, causes the centrifugal forces acting upon said material to be greater than ninety percent of gravitational forces acting upon said material but slightly less than one-hundred percent of gravitational forces action upon said material.

8. The method of claim 6 wherein the rotational speed of said rotary kiln, is maintained for a period that causes centrifugal forces acting upon said material to be between ninety percent of gravitational forces acting upon said material and ninety-five percent of gravitational forces acting upon said material.

9. The method of claim 6 wherein said material is granular material.

10. The method of claim 7 wherein said material is granular material.

11. The method of claim 8 wherein said material is sand.

12. The method of claim 9 wherein said granular material is sand.

13. A method of increasing interaction of solid material processed by and passing through a rotary kiln with gas inside the rotary kiln, wherein said material passes through the kiln from an inlet end to a discharge area at the opposite end of the kiln, said method including:

(a) rotating the rotary kiln thereby causing said material to be transported by centrifugal force upwardly on said shell without the use of flights; and (b) rotating the rotary kiln at a rotational speed for a period that causes centrifugal forces acting upon said material to be between ninety percent of gravitational forces acting upon said material but slightly less than one-hundred percent of gravitational forces acting upon said material, wherein the maximum rotational speed is below the speed where the centrifugal force acting upon said material is equal to the gravitational force, and said rotational speed causes 100% of said material to flow downwardly in freefall solely by virtue of gravity from said shell per revolution of the kiln.

14. The method of claim 13 wherein the rotational speed of said rotary kiln, is maintained for a period that causes centrifugal forces acting upon said material to be between ninety percent of gravitational forces acting upon said material and ninety-five percent of gravitational forces acting upon said material.

15. The method of claim 13 wherein said material is granular material.

16. The method of claim 14 wherein said material is granular material.

17. The method of claim 1 wherein the rotational speed of said rotary kiln, is maintained for a period that causes centrifugal forces acting upon said material to be between ninety percent of gravitational forces acting upon said material and ninety-five percent of gravitational forces acting upon said material.

* * * * *

UNITED STATES PATENT AND TRADEMARK OFFICE

CERTIFICATE OF CORRECTION

PATENT NO. : 9,080,813 B1
APPLICATION NO. : 12/798873
DATED : July 14, 2015
INVENTOR(S) : George J. Deckebach It is certified that error appears in the above-identified patent and that said Letters Patent is hereby corrected as shown below:

In the Claims
Column 8, line 49, Claim 1, line 14, delete "just"

Signed and Sealed this
Seventeenth Day of November, 2015

Michelle K. Lee

Michelle K. Lee
*Director of the United States Patent and Trademark Office*